US005827975A

United States Patent [19]

De Jager et al.

[11] Patent Number: 5,827,975

[45] Date of Patent: Oct. 27, 1998

[54] METHOD AND APPARATUS FOR MEASURING THE TENSION OF THE WARP IN A WEAVING MACHINE

[75] Inventors: Godert De Jager, Volketswil; Dietmar Markward, Rüti; Lorant Gacsay, Zürich, all of Switzerland

[73] Assignee: Sulzer Rueti AG, Rueti, Switzerland

[21] Appl. No.: 766,381

[22] Filed: Dec. 5, 1996

[30] Foreign Application Priority Data

Feb. 5, 1996 [EP] European Pat. Off. ..... 96810074

[51] Int. Cl.[6] ..... G01N 3/08

[52] U.S. Cl. ..... 73/828; 73/862.46

[58] Field of Search ..... 73/826, 827, 828, 73/829, 831, 843, 862.46, 862.451, 862.391

[56] References Cited

U.S. PATENT DOCUMENTS

| | | | |
|---|---|---|---|
| 3,366,299 | 1/1968 | Rose et al. | 73/829 |
| 3,526,252 | 9/1970 | Hindle | 139/110 |
| 3,933,035 | 1/1976 | Roch | 73/829 |
| 3,994,162 | 11/1976 | Auckland et al. | 73/862.46 |
| 4,384,494 | 5/1983 | Taylor | 73/862.42 |
| 4,619,294 | 10/1986 | Sainen et al. | 139/99 |
| 4,817,677 | 4/1989 | Deconinck et al. | 139/99 |

FOREIGN PATENT DOCUMENTS

| | | |
|---|---|---|
| 1008135A | 1/1996 | Belgium . |
| 0 527 705 | 2/1993 | European Pat. Off. . |
| 0 547 003 | 6/1993 | European Pat. Off. . |
| WO 93/25743 | 12/1993 | WIPO . |

*Primary Examiner*—George M. Dombroske
*Assistant Examiner*—Max H. Noori
*Attorney, Agent, or Firm*—Townsend and Townsend and Crew LLP

[57] ABSTRACT

In the method a force $F_M$ is measured which has substantially the same magnitude over the pivotal range depending on the path of the warp and on the geometrical arrangement of the deflection member, of the tensioning member and of the pivot axis.

The tension of the warp can thereby be substantially correctly determined independently of the position of the tensioning member by measurement of the force $F_M$, and the measured value can be directly incorporated into the regulation of the warp let-off.

14 Claims, 4 Drawing Sheets

METHOD AND APPARATUS FOR MEASURING THE TENSION OF THE WARP IN A WEAVING MACHINE

BACKGROUND OF THE INVENTION

The invention relates to a method for measuring the tension of the warp in a weaving machine and to an apparatus for carrying out the method.

Within a weaving cycle the warp threads are deflected to a greater or lesser extent by the heddles so that fluctuations in tension occur in the warp threads. In order to compensate for these fluctuations, i.e. to hold the tension in the warp threads as constant as possible, the tensioning beam, which stands under the action of a spring, executes a pivotal movement.

An analysis of the forces acting on the tensioning beam shows that the resultant force as well as the component forces-vary during the pivotal movement.

It is disadvantageous that large deviations arise for relatively small pivot angles and must be compensated for by providing control systems at substantial extra cost and complexity.

SUMMARY OF THE INVENTION

The invention alleviates the problems encountered in the past by providing a method and an apparatus for measuring the tension of a warp thread, with the deviations being held in narrow bounds and the measurement values being supplied at low cost and complexity for the direct incorporation into a control system.

The invention will be explained in the following with regard to the accompanying drawings.

DETAILED DESCRIPTION OF THE PREFERRED EMBODIMENTS

Figure 1:
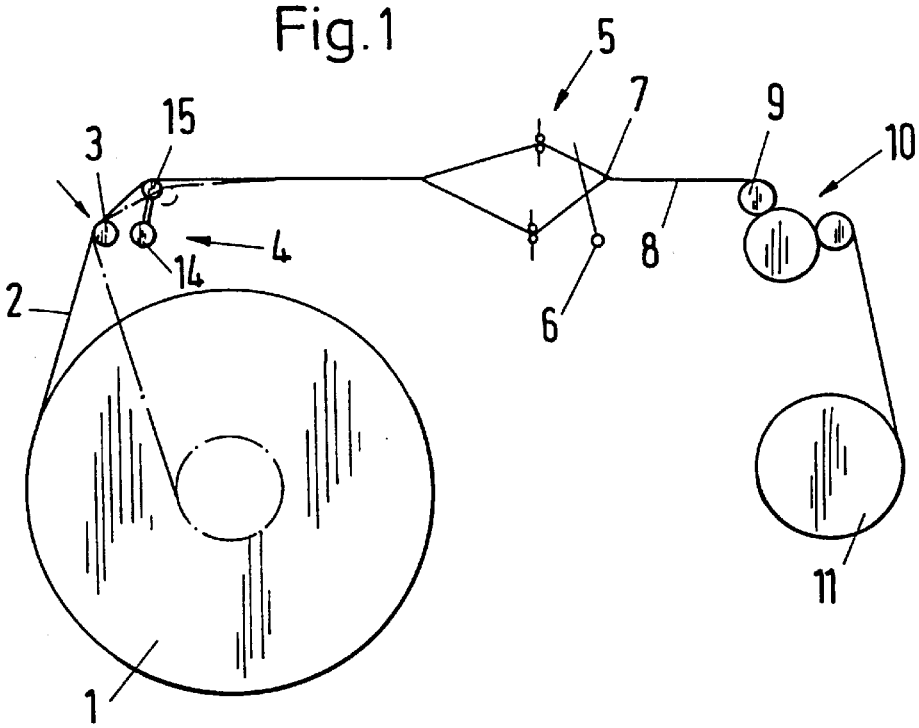
FIG. 1 is a schematic illustration of the path of the warp thread and of the cloth in a weaving machine.

FIG. 1 shows the path of the warp threads and the cloth in a weaving machine as well as the elements of the weaving machine cooperating with them. Warp threads 2 unwound from a warp beam 1 controlled by a warp release device (not shown) pass over a deflection beam 3 and an apparatus 4 for tensioning the warp 2 to a plurality of heddles 5 and through a reed 6 up to the interlacing point 7. Beyond the interlacing point 7 a cloth 8 runs over a breast beam 9 and a cloth take-up device 10 to a cloth beam 11, where the cloth is rolled up.

The apparatus 4 being discussed here contains a carrying beam 14, which is mounted either at a fixed position or pivotally in the weaving machine, and a tensioning beam 15, which is connected to the carrying beam 14 and can be pivoted about an axis 16 around the fixed carrying beam or along with the carrying beam. The tensioning beam 15 is of low mass, i.e. is executed in the form of a tube, and is journalled at a plurality of bearing points within the weaving breadth. Embodiments of the apparatus 4 in accordance with the invention will be described with reference to FIGS. 3 to 6. The weaving machine is executed in such a manner that the tensioning beam takes on a base position 0° within its pivotal range in the vertical position with respect to its pivotal axis and can be pivoted for example by ±25° with respect to this base position, with the + sign designating a pivotal motion in the direction of travel of the warp and the − sign a direction of travel opposite that of the warp.

In the method of the invention, there is determined, within the pivotal range, a partial pivotal range which is required for maintaining the tension in the warp on the basis of the technical textile data and the yarn-specific data. The absolute value of this partial pivotal range and its geometrical position within the pivotal range depends mainly on the elasticity of the warp yarn but lies in practice within the range from 0° to 20°, advantageously within the range from 0° to 15°.

By the subdivision of the pivotal movement in the pivotal range it is possible to specify a force profile for a force $F_M$ directed in the direction of the warp travel having variations which remain within narrow bounds. This force $F_M$ is measured at one of the bearing points. By means of a force pickup which is oriented along the line of action of the force $F_M$ a substantially constant signal is thus produced which can be incorporated into the control system. Within the pivotal movement of the tensioning beam the pivotal range corresponding to the properties of the yarn can thus be determined in order to produce the required warp tension $F_K$ in the warp.

Figure 2:
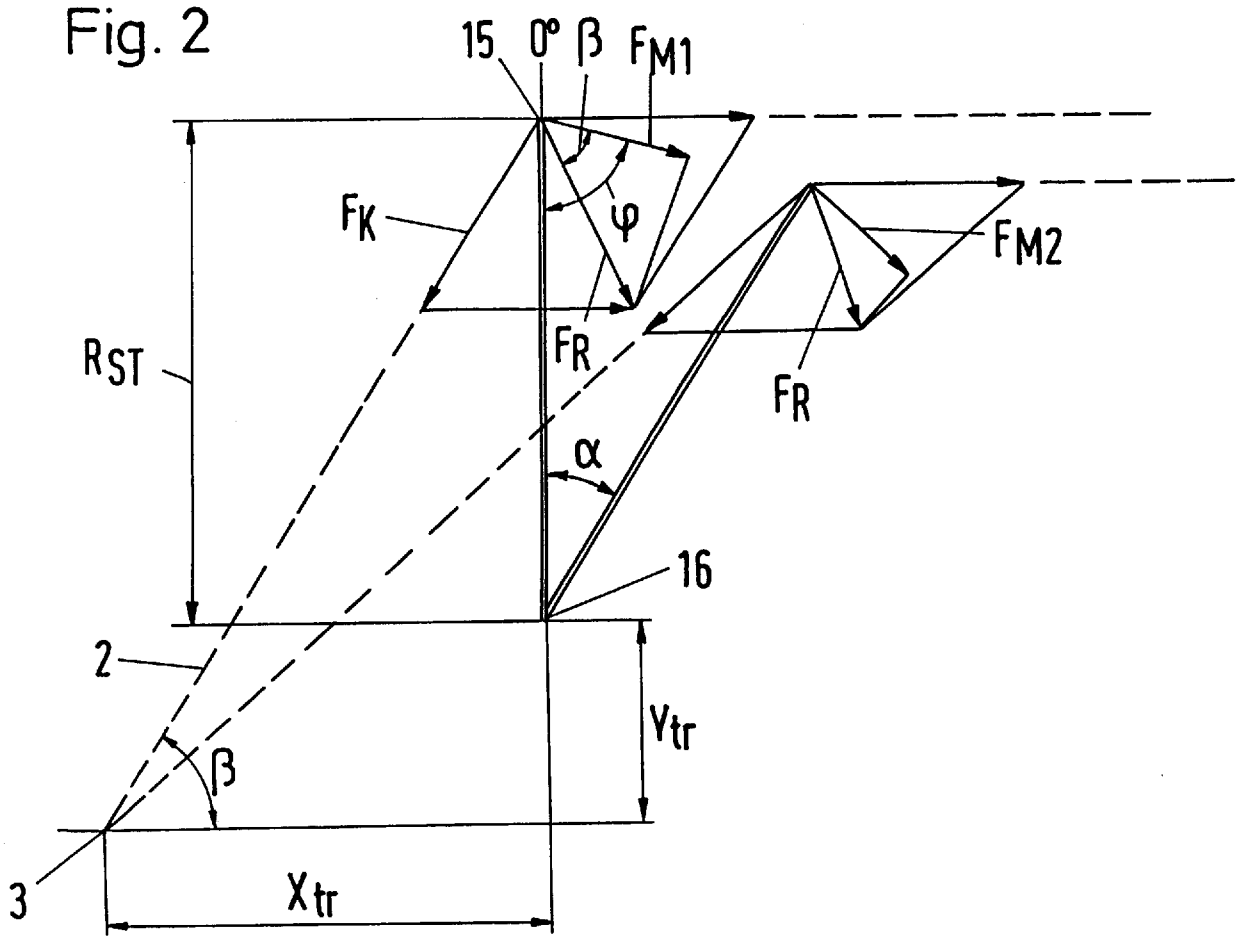
FIG. 2 is a schematic illustration of the force acting on the tensioning member.

Reference is made to FIG. 2, which shows schematically the association of the elements and forces relevant to the method in accordance with the invention in two pivotal positions within a partial pivotal range.

The path of the warp, which is shown as a train of lines in FIG. 2 for the cases in which the tensioning beam 15 takes on the base position and a pivoted position respectively, results from the geometrical arrangement of the deflection beam 3 and of the tensioning beam 15, which can be pivoted about the axis 16.

As seen from FIG. 2 the resultant force $F_R$ lies along the mean of the normals to the lines in the train and varies in magnitude and direction. As a result of these variations, the force $F_R$ is unsuitable for a measurement. In the method in accordance with the invention, a force $F_M$ to be measured is determined on the basis of the geometrical arrangement and the train of lines, whose variation in the direction with respect to the connection $R_{ST}$ between the carrying beam and the tensioning beam is constant and is nearly constant in magnitude.

In the determination of $F_M$ it is assumed that the warp force $F_K$ is constant. Thus the value of $F_R$ is dependent only on the angle $\alpha$.

From this it follows that: $F_R=f(\alpha)$.

During pivoting, the value of the angle $\beta$ changes. This variation is dependent on the change of the angle $\alpha$ as well as of the angle $\phi$.

Hence: $\beta=f(\alpha,\phi)$.

Since the angle $\phi$ is to remain constant over the partial pivotal range, it follows therefrom that $$F_M=F_R\cdot\cos\beta.$$

Under the condition that $$F_M = \text{const.}$$

there results:

$$F_R(\beta_1)\cdot\cos\beta(\alpha_1,\phi)=F_R(\alpha_2)\cdot\cos\beta(\alpha_2,\phi)$$

or $$\frac{F_R(\alpha_1)}{F_R(\alpha_2)}=\frac{\cos\beta(\alpha_2,\phi)}{\cos\beta(\alpha_1,\phi)}.$$

The angle $\phi$ can be determined for a given pivotal range using this equation.

Afterwards, the pivotal range for the tensioning beam is fixed in such a manner that the base position lies within the partial pivotal range. In this way the warp tension can be substantially correctly determined by measurement of the force $F_M$ independently of the position of the tensioning beam, and the measured value directly incorporated into the control of the warp release.

Figure 3:
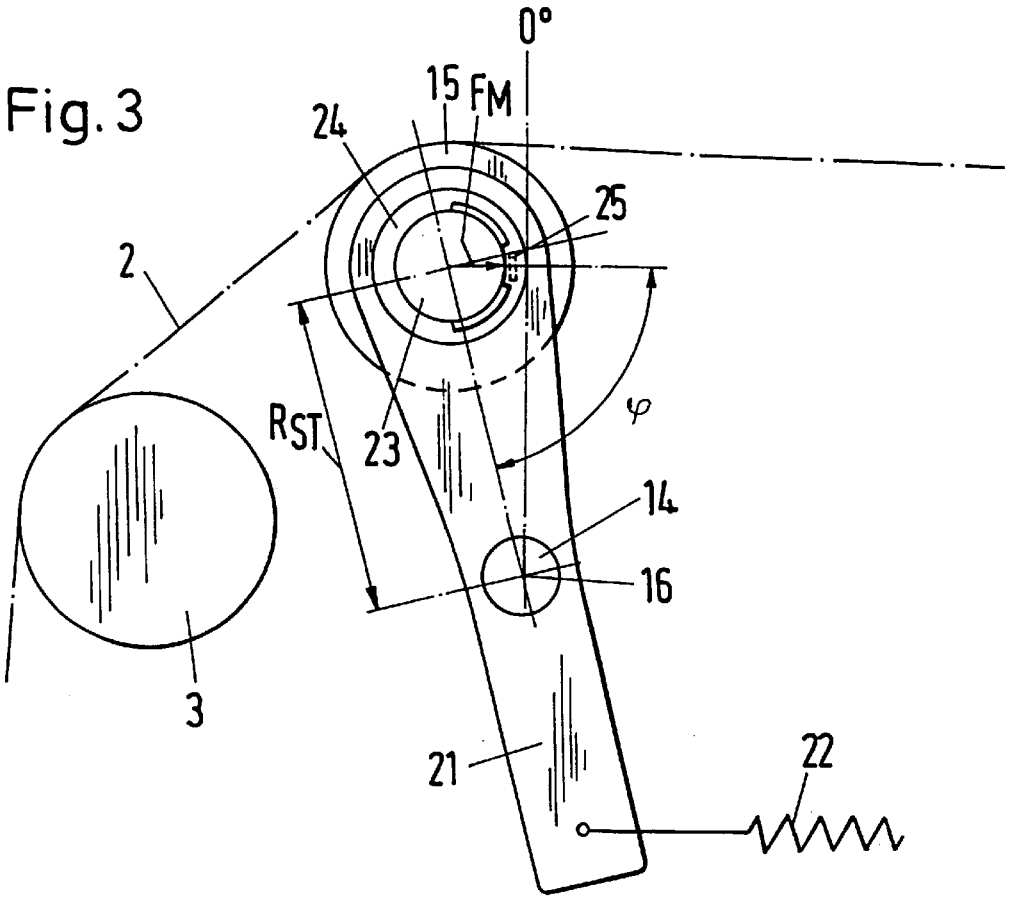
FIG. 3 shows a first embodiment of an apparatus in accordance with the invention.

FIG. 3 shows a first embodiment of an apparatus 4 in accordance with the invention. The tensioning beam 15 is journalled at each of its ends in a lever 21 which is placed on the positionally fixed carrying beam 14 and can be pivoted about the axis 16. A spring 22 is provided in order to produce the tensioning action in the warp 2. The tensioning beam 15 is provided with bearing pins 23, each of which is rotationally movably arranged in a bearing bush 24. A force pickup 25 is integrated into the bearing bush 24 in such a manner that the normal extends in the center of the pressure pickup surface and through the center point of the bearing bush. The bearing bush 24 is placed in the lever 21 in such a manner that the normal coincides with the line of action of the force $F_M$. The fixing of the bearing bush 24 in the bore of the lever 21 can be carried out by means of a set screw, a pin or the like.

Figure 4:
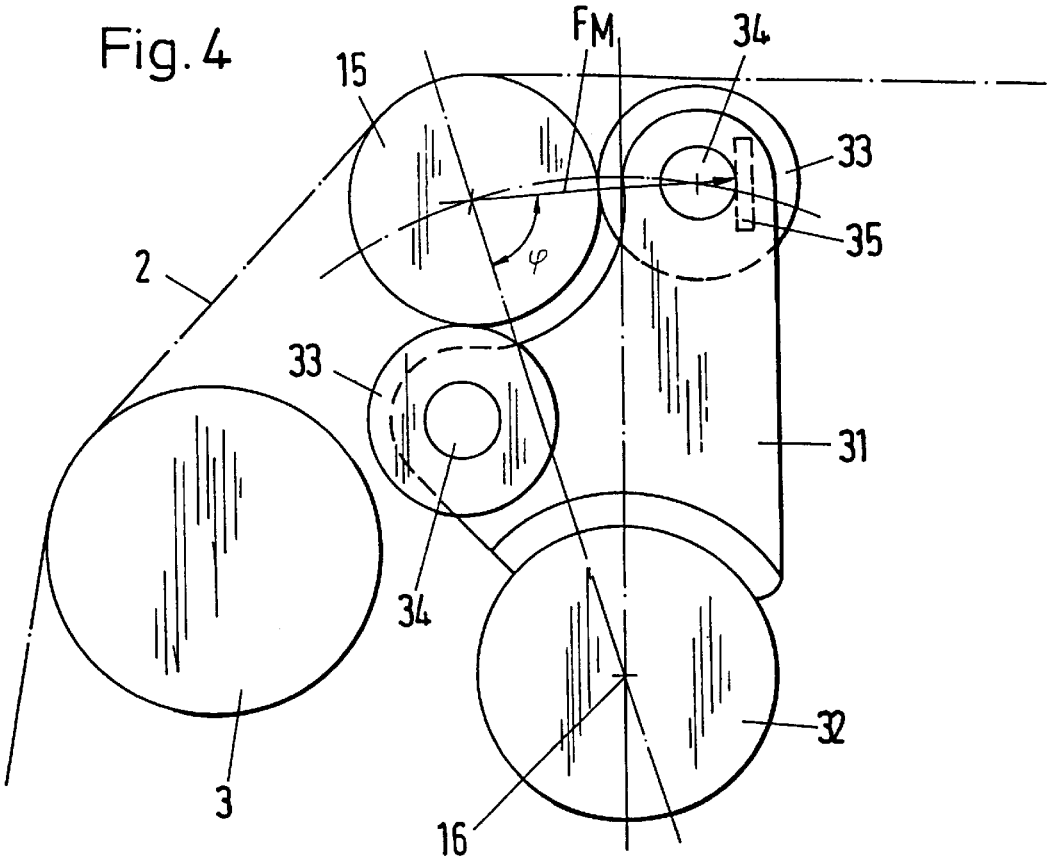
FIG. 4 shows a second embodiment of an apparatus in accordance with the invention.

In the embodiment shown in FIG. 4 the tensioning beam 15 is braced in a rolling manner. A bearing bracket 31 is provided for this purpose. The bearing bracket 31 is placed on a shaft 32 which is acted on by a spring and can be pivoted about the axis 16. Two rollers 33 with bearing pins 34 are provided which are journalled in the bearing bracket 31. A force pickup 35 is associated with one of the rollers 33 and is arranged in the bearing bracket 31 and connected in a force transmitting manner to the bearing pin 34 in such a manner that the normal at the center of the pressure pickup surface coincides with the line of action of the force $F_M$.

Figure 5:
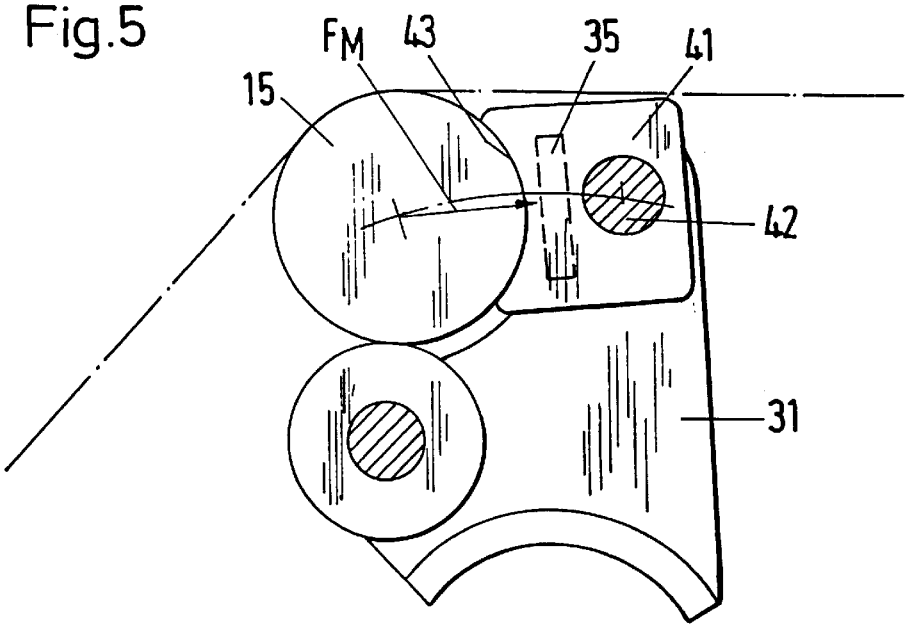
FIG. 5 shows a third embodiment of an apparatus in accordance with the invention.

FIG. 5 shows an embodiment of an apparatus in accordance with the invention in which a support part 41 is pivotally located in the bearing bracket 31 in place of a roller. The support part 41 has bearing pins 42 which are rotatably journalled in the bearing bracket 31 and a semicircular recess 43 whose radius is matched to the outer diameter of the tensioning beam 15 so that the recess 43 is in a form-fitted connection with the tensioning beam. A force pickup 35 is placed in the support part 41 in such a manner that the normal to the pressure pickup area passes through the centerline of the radius of the recess 43.

Figure 6:
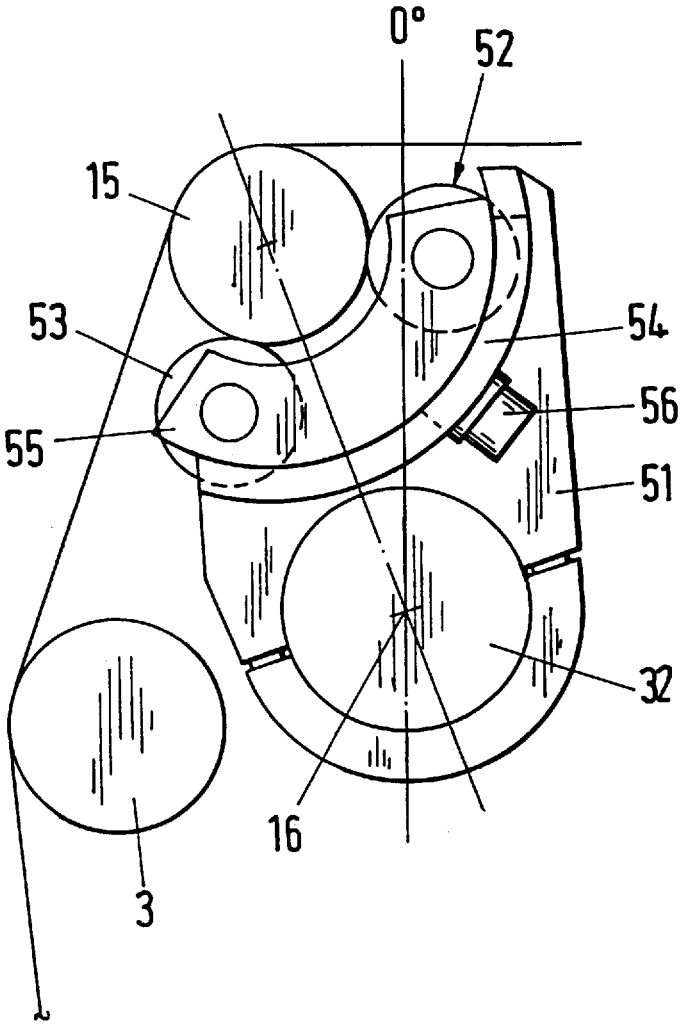
FIG. 6 shows a fourth embodiment of an apparatus in accordance with the invention.

FIG. 6 shows an embodiment of the apparatus in accordance with the invention in which the tensioning beam 15 is braced in a rolling manner. For this purpose there are provided a carrier part 51 which is secured to the shaft 32 and an arrangement 52 with two rollers 53 which is adjustably mounted on the carrier part 51. A curved reception part 54 for the arrangement 52 is secured to the carrier part 51. The radius of curvature of the curved reception part 54 lies on the centerline of the tensioning beam 15 braced against the rollers 53 of the arrangement 52. The arrangement 52 has a cage 55 in which the rollers 53 are rotatably journalled. The cage 55 is executed in such a manner that it lies on the pick-up part 52 in a form-fitted manner. A force pickup (not shown in FIG. 6) is associated with one of the rollers 53 and is located in the cage 55 and connected in a force transmitting manner to the bearing pin of the roller in such a manner that the normal to the pressure pickup surface passes through the roller 33.

The arrangement 52 is mounted adjustably on the pick-up part 54 in order to adjust the normal to the pressure pickup surface to the force $F_M$ to be measured so that the normal to the pressure pickup surface and the line of action of the force $F_M$ coincide. A screw 56 is provided in order to secure the adjustment position.

In the method a force $F_M$ is measured which has about the same magnitude over the pivotal range in dependence on the path of the warp 2 and on the geometrical arrangement of the deflection member 3, of the tensioning member 15 and of the pivotal axis 16.

In this way the warp tension can be substantially correctly determined by measurement of the force $F_M$ independently of the position of the tensioning member, and the measured value can be directly incorporated in the control of the warp let-off.

What is claimed is:

1. Method for the measurement of tension in a warp of a weaving machine, wherein the warp is led along a path over a deflection member and a rotationally symmetrical tensioning member which is pivotable over a pivotal range, is acted on by a spring, and is pivoted about an axis under the action of the warp, wherein a force acting on the tensioning member is measured by a force pickup connected in a force transmitting manner to the tensioning member, and measuring a force $F_M$ which has a substantially constant magnitude over the pivotal range in dependence on the path of the warp and on a geometrical arrangement of the deflection member, the tensioning member and the pivot axis.

2. Method in accordance with claim 1 wherein the force $F_M$ is measured whose line of action includes an angle $\phi$ of less than or more than 90° relative to a plane connecting a centerline of the tensioning member and the pivot axis; and wherein the force is measured during back-and-forth motions of the tensioning member.

3. Method in accordance with claim 1 wherein the tensioning member is pivoted in selectable partial ranges of about 15°; and including determining a line of action of the force $F_M$ to be measured for each partial pivotal range.

4. Apparatus for the measurement of tension in a warp of a weaving machine, comprising a deflection member over which the warp is led along a path and a rotationally symmetrical tensioning member which is pivoted about an axis, a force pickup device which has a pressure pickup surface that is elastic in bending and includes at least one measurement element which is connected to the pressure pickup surface, the force pickup device and the tensioning member being arranged with respect to one another so that a normal line at a center of the pressure pickup surface and a line along which a force $F_M$ acts and which is to be measured by the measuring element extend in substantially the same direction.

5. Apparatus in accordance with claim 4 wherein the force pickup device and the tensioning member are so arranged with respect to one another that the normal line and the line along which the force $F_M$ acts coincide.

6. Apparatus in accordance with claim 4 wherein the tensioning member is supported at bearing locations; and wherein the force pickup device is provided at at least one bearing location.

7. Apparatus in accordance with claim 4 wherein the tensioning member comprises a structure which is pivotable about an axis, a spring acting on the structure, and an arrangement for receiving the tensioning member, wherein the force pickup device is integrated into the arrangement, and wherein the arrangement is adjustable with respect to the structure in a peripheral direction of the tensioning member for substantially aligning the force pickup device with the line along which the force $F_M$ to be measured acts.

8. Apparatus in accordance with claim 7 including setting means for adjusting the arrangement with respect to the line alone which the force $F_M$ to be measured acts.

9. Apparatus in accordance with claim 7 wherein the arrangement comprises a bearing bush placed in the structure and means for securing the bearing bush against rotation; and wherein the force pickup device is integrated into the bearing bush.

10. Apparatus in accordance with claim 7 wherein the arrangement comprises a cage and first and second rollers; and wherein the force pickup device is connected to one of the rollers in a force transmitting manner.

11. Apparatus in accordance with claim 4 including a bearing bracket mounting first and second rollers which brace the tensioning member; and wherein the force pickup device is connected to one of the rollers in a force transmitting manner.

12. Apparatus in accordance with claim 4 including a bearing bracket mounting a roller and a support member bracing the tensioning member; and wherein the force pickup device is located in the support member.

13. Apparatus in accordance with claim 4 including a warp beam from which the warp extends in a downstream direction towards a warp interlacing point of the weaving machine, and wherein the tensioning member is disposed between the warp beam and the warp interlacing point.

14. A method for measuring tension in a warp of a weaving machine, the warp being formed by a multiplicity of warp yarns, comprising the steps of providing a deflection member and a rotationally symmetrical tensioning member which is pivotable about a pivot axis; biasing the tensioning member about its pivot axis in a first direction; leading the multiplicity of warp yarns over the deflection member and the tensioning member to thereby subject the tensioning member to a force which pivots the tensioning member in a second direction opposite to the first direction about the pivot axis and over a pivotal movement range; geometrically positioning the deflection member, the tensioning member and the pivot axis relative to each other so that the application of the force generates a component force $F_M$ which is substantially constant over the pivotal movement range of the tensioning member; and measuring the component force $F_M$ with a force pickup device operatively coupled to the tensioning member.

* * * * *